US005862573A

United States Patent [19]

Leifeld

[11] Patent Number: 5,862,573

[45] Date of Patent: Jan. 26, 1999

[54] CARDING MACHINE HAVING A FIBER INTRODUCING APPARATUS

[75] Inventor: Ferdinand Leifeld, Kempen, Germany

[73] Assignee: Trützschler GmbH & Co, KG, Mönchengladbach, Germany

[21] Appl. No.: 124,774

[22] Filed: Sep. 22, 1993

Related U.S. Application Data

[63] Continuation-in-part of Ser. No. 760,892, Sep. 17, 1991, Pat. No. 5,255,415.

[30] Foreign Application Priority Data

Sep. 22, 1992 [DE] Germany ..... 42 31 694.4

[51] Int. Cl.[6] ..... D01G 15/20

[52] U.S. Cl. ..... 19/105

[58] Field of Search ..... 19/65 A, 98, 100, 19/105, 112, 114, 102, 104, 113

[56] References Cited

U.S. PATENT DOCUMENTS

| | | | |
|---|---|---|---|
| 166,407 | 8/1875 | Plantron | 19/112 |
| 407,743 | 7/1889 | Proctor | 19/105 |
| 481,024 | 8/1892 | Hanscom | 19/105 |
| 766,486 | 8/1904 | Barber | 19/105 X |
| 864,515 | 8/1907 | Collins | 19/105 |
| 2,086,308 | 7/1937 | Van Hille et al. | 19/105 |
| 2,295,762 | 9/1942 | Schultze | 19/97 |
| 2,725,599 | 12/1955 | Schorsch et al. | 19/105 X |
| 2,964,801 | 12/1960 | Riehl et al. | 19/100 |
| 3,123,866 | 3/1964 | Stewart et al. | 19/97 |
| 3,373,461 | 3/1968 | Bessette et al. | 19/105 X |
| 3,737,951 | 6/1973 | Mackie | 19/112 X |
| 3,808,640 | 5/1974 | Graf | 19/113 |
| 3,995,351 | 12/1976 | Otani | 19/102 |
| 4,162,559 | 7/1979 | Stewart | 19/113 |
| 4,274,177 | 6/1981 | Grimshaw et al. | 19/105 X |
| 4,355,439 | 10/1982 | Estebanell | 19/105 |
| 4,510,949 | 4/1985 | Preston et al. | 19/97 X |
| 4,969,235 | 11/1990 | Marx | 19/105 |
| 5,255,415 | 10/1993 | Leifeld et al. | 19/107 |

FOREIGN PATENT DOCUMENTS

| | | | |
|---|---|---|---|
| 127043 | 5/1901 | Germany . | |
| 704381 | 3/1941 | Germany . | |
| 36 44 529 | 7/1988 | Germany . | |
| 41 20 531 | 1/1992 | Germany . | |
| 3057 | 8/1877 | United Kingdom | 19/114 |
| 0008560 | 6/1887 | United Kingdom | 19/105 |

OTHER PUBLICATIONS

Prof.Dr.–Ing. E. H. Otto Johannsen, Handbuch Der Baumwollspinnerei, Berlin–Hamburg–pp. 14–18, 1962.

*Primary Examiner*—Ismael Izaguirre
*Attorney, Agent, or Firm*—VENABLE; Gabor J. Kelemen

[57] ABSTRACT

A carding machine includes a main carding cylinder and an apparatus for introducing fiber material to the main carding cylinder. The apparatus includes a fiber feeding device and at least one licker-in having a sawtooth clothing and being disposed between the fiber feeding device and the main carding cylinder. The apparatus further has at least one pin roll having a pin clothing and being flanked by the fiber feeding device and the licker-in .

20 Claims, 6 Drawing Sheets

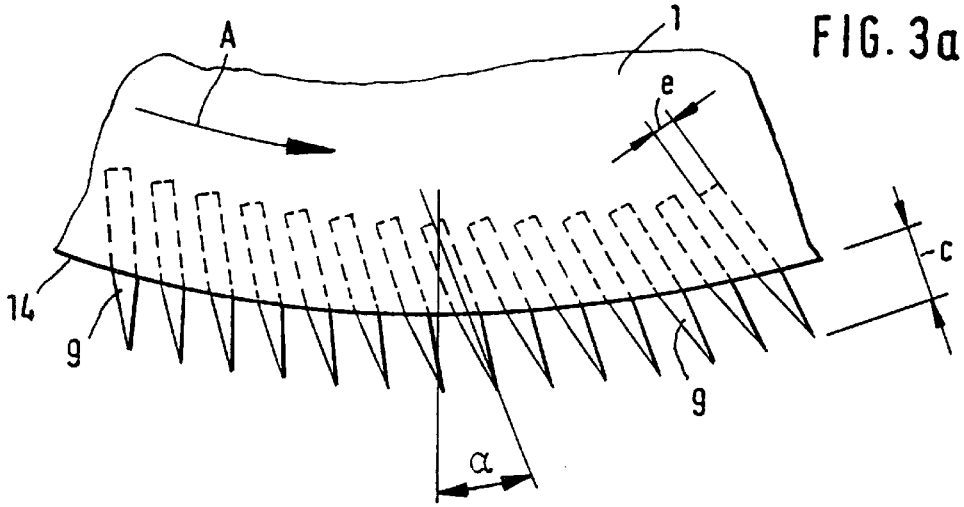
FIG. 3a
FIG. 3b
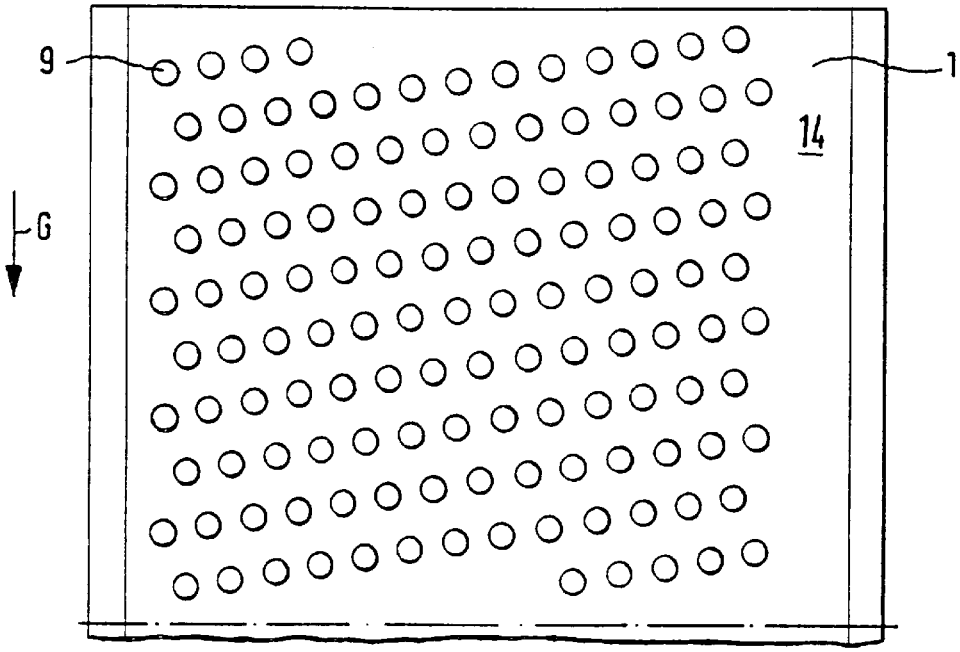
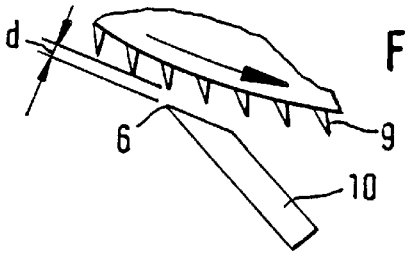
FIG. 3c

CARDING MACHINE HAVING A FIBER INTRODUCING APPARATUS

CROSS REFERENCE TO RELATED APPLICATION

This application is a continuation-in-part of application Ser. No. 760,892, filed Sep. 17, 1991, now U.S. Pat. No. 5,255,415 issued Oct. 26, 1993.

This application claims the priority of German Application No. P 42 31 694.4 filed Sep. 22, 1992, which is incorporated herein by reference.

BACKGROUND OF THE INVENTION

This invention relates to an apparatus which forms part of a carding machine and which serves for introducing fiber material to the main carding cylinder. The apparatus includes a fiber feeding device and, downstream thereof and upstream of the carding cylinder (as viewed in the direction of fiber advance), a licker-in provided with a sawtooth clothing. In case a plurality of licker-ins is provided in a series, in any pair of adjoining licker-ins, the downstream licker-in cooperates with the adjoining upstream licker-in as a doffer and opening roll.

In a known apparatus, between the fiber feeding device and the main carding cylinder, three licker-ins are provided, each carrying a sawtooth clothing. Immediately downstream of the feeding device which is formed of a feed roll and a feed table cooperating therewith, a first licker-in is arranged. The first licker-in receives fiber material which has already been pre-opened and pre-cleaned by a cleaner forming part of a fiber processing line and situated upstream of the carding machine. It is a disadvantage of such a conventional arrangement that the sawteeth of the licker-in immediately following the fiber feeding device of the carding machine penetrate very aggressively into the fiber material.

SUMMARY OF THE INVENTION

It is an object of the invention to provide an improved apparatus of the above-outlined type which avoids the discussed disadvantage and which thus, in particular, ensures a gentle and improved cleaning of the fiber material prior to its introduction to the main carding cylinder of the carding machine.

This object and others to become apparent as the specification progresses, are accomplished by the invention, according to which, briefly stated, between the feeding device and the sawtooth-clothed licker-in at least one clothed fiber processing roll having a clothing other than a sawtooth clothing, such as a pin roll, needle roll or the like (hereafter generally referred to as a pin roll) is arranged.

The measures according to the invention provide for a functional separation of fiber processing, in that immediately downstream of the fiber feeding device a pin roll is positioned whose pins comb and clean the fiber material slowly advanced thereto without undesired damage to the fibers. The pin roll is immediately followed by a licker-in which has a sawtooth clothing and which takes over and advances the already-accelerated fiber material. The licker-in rotates with a higher circumferential speed than the pin roll, whereby an intensified cleaning of the fiber material is effected. In this manner the fiber material is gradually accelerated under gentle treatment. The fiber opening is performed in a stepped and thus gentle manner and, at the same time, by providing a plurality of cleaning rolls in conjunction with an increase of the circumferential speed from roll-to-roll in the downstream direction, a significantly increased cleaning effect is achieved.

According to a further feature of the invention, the feeding device includes a slowly rotating feed roll and a feed table cooperating therewith. By virtue of combining such a feeding device with an after-connected pin roll or needle roll, a particularly gentle opening of the fiber material is ensured.

The invention has the further additional advantageous features:

With each licker-in there is associated a mote knife and a waste discharge opening for an additional thorough cleaning of the fiber material.

The diameter of the licker-ins is identical which ensures a more economical manufacture and a simpler stock keeping.

The diameter of the licker-ins is between 160 and 200 mm.

The direction of rotation of any licker-in is opposite to the direction of rotation of the immediately adjoining licker-in, and the circumferential speed of each licker-in is greater than that of the immediately upstream licker-in. By virtue of the gradual speed increase from licker-in to licker-in there is obtained a finer division of the fibers and a further improved cleaning thereof.

For further augmenting the cleaning effect, with each licker-in at least one stationary carding element is associated.

The pins of the pin roll are inclined towards the direction of rotation; the angle of inclination a is approximately 10°–15° to the roll radius intersecting the inner, embedded end of the respective tooth. By virtue of the oblique positioning of the pins, a superior combing with particularly gentle opening effect is achieved.

The needles project from the securing surface to a height of approximately 4–20 mm and have a density of approximately 0.5–2 per $cm^2$. By selecting the pin height and pin density the card may be optimally adapted to the fiber materials.

The distance between the cutting edge of the mote knife and an imaginary cylinder circumscribable about the clothing is preferably between 0.5 and 5 mm. The mote knife structure preferably includes a stationary carding element.

With the mote knife a suction device for trash and other waste is associated and a guide element is arranged upstream of the cutting edge of the mote knife. The distance of the guide element from the pin roll is adjustable. By setting the distance of the guide element it is possible to vary the degree of separation and thus adapt the treatment to the particular fiber material. The suction device associated with the mote knife serves for the immediate removal of waste.

Between the mote knife and each upstream-arranged roll cover and each upstream-arranged guide element a waste discharge opening is provided; in this manner waste may be removed from each licker-in at different locations to thus further increase the cleaning effect.

Above and/or below the pin roll or pin rolls at least one curved cover (shroud) is arranged. In this manner the guidance of the waste contained in the fiber material to the respective waste discharge openings is improved.

BRIEF DESCRIPTION OF THE DRAWING

FIG. 3*a* is a schematic fragmentary side elevational view of a pin roll forming part of the invention.

FIG. 3*b* is a fragmentary top plan view of the construction shown in FIG. 3*a*.

FIG. 3*c* is a schematic fragmentary side elevational view of a pin roll with associated mote knife forming part of the invention.

DESCRIPTION OF THE PREFERRED EMBODIMENTS

Figure 1:
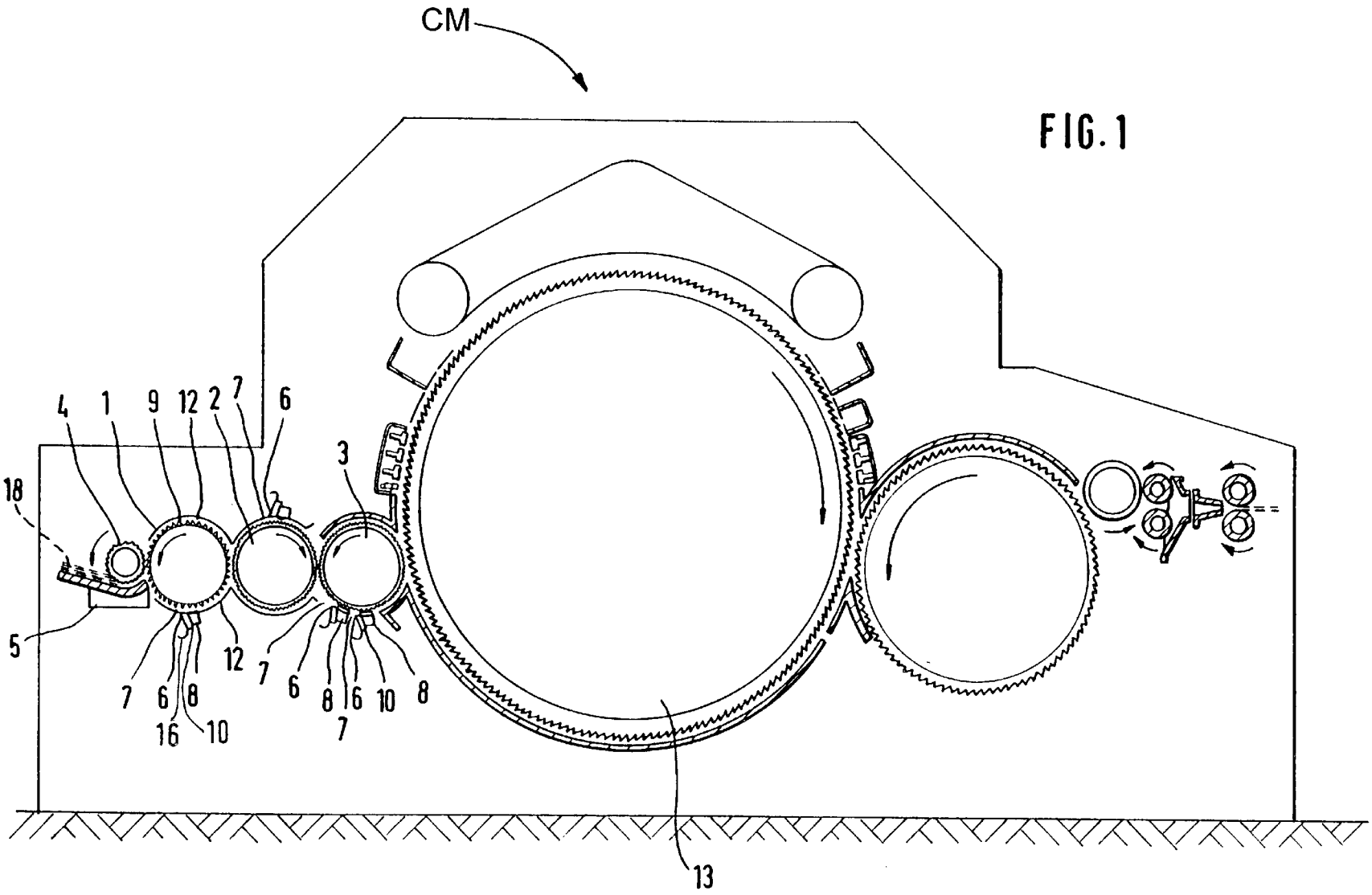
FIG. 1 is a schematic side elevational view of a carding machine incorporating the invention.

Turning to FIG. 1, a fiber batt 18 is advanced to a fiber feeding device of a carding machine CM which may be a DK 760 model high production card manufactured by Tr ützschler GmbH & Co. KG, Mönchengladbach, Germany. The feeding device is formed of a feed roll 4 and a feed table 5 cooperating therewith. The fiber batt 18 is firmly held between the feed roll 4 and the feed table 5 and, by virtue of the rotation of the feed roll 4, the fiber batt 18 is slowly advanced to a pin roll 1. The pins 9 of the pin roll 1 penetrate into the advanced batt 18 and remove fibers from the batt 18 which fibers are further advanced by the pins 9. The pin roll 1 rotates in the same sense as, but significantly faster than the feed roll 4. The removed (loosened) fibers entrained by the pin roll 1 pass by a waste discharge opening 7 where a mote knife 10 is positioned whose knife edge 6 removes waste which is carried away in a suction hood 16.

Figure 2:
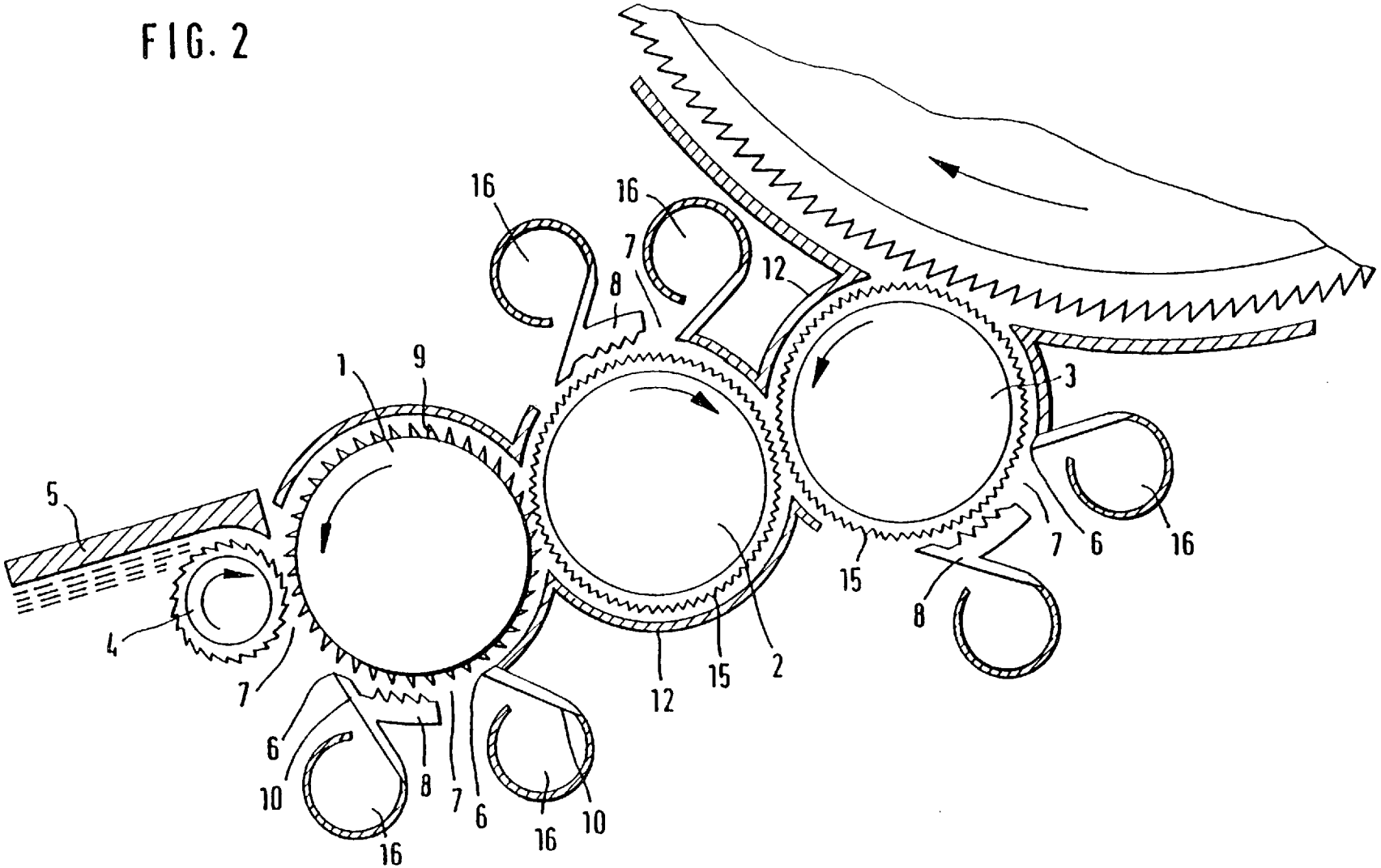
FIG. 2 is a schematic sectional side elevational view of a preferred embodiment of the invention.
Figure 6:
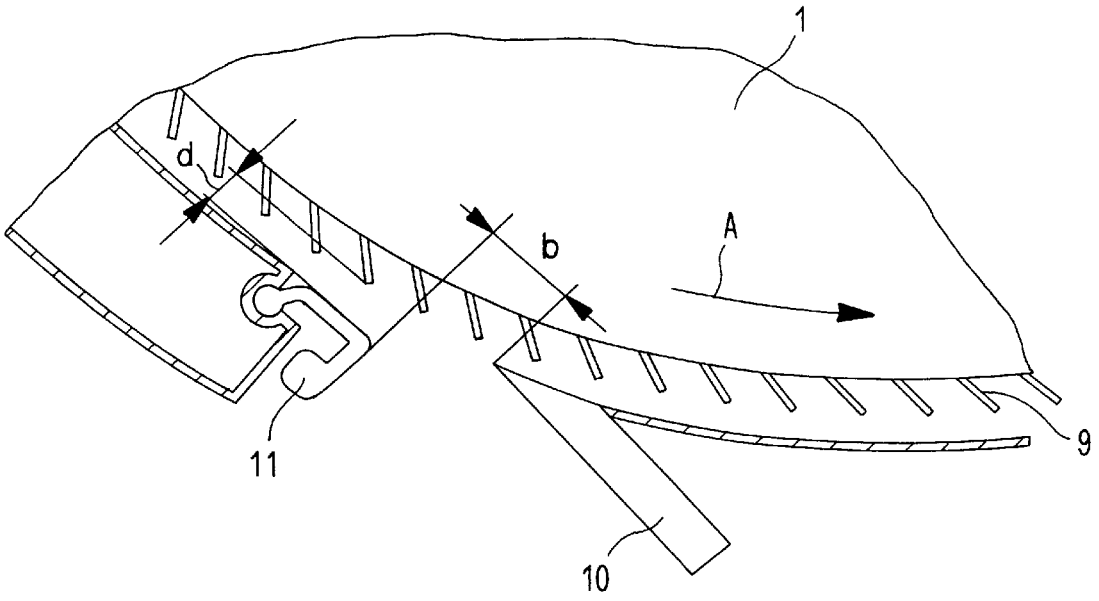
FIG. 6 is a schematic fragmentary side elevational view of a pin roll with associated mote knife and guide element forming part of the invention.

Also referring to FIGS. 2, 3*c* and 6, in their travel past the waste discharge opening 7 the fiber material, as entrained by the pins 9 of the pin roll 1, passes by a stationary carding element 8 which may be unitary with the mote knife 10 and then arrives in the zone of a licker-in 2 which is provided with a sawtooth clothing 15. The licker-in 2 too, is provided with a suction hood 16 adjoined by a mote knife 10. The waste discharge opening 7 is bounded as viewed in the direction of rotation of the licker-in 2, by a guide element 11 and the mote knife 10. A setting device (not shown) of known construction provides for an adjustment of the mote knife 10 and the guide element 11, that is, the distance d (FIGS. 3*c* and 6) may be adapted to the fiber material actually handled by the apparatus.

Figure 4:
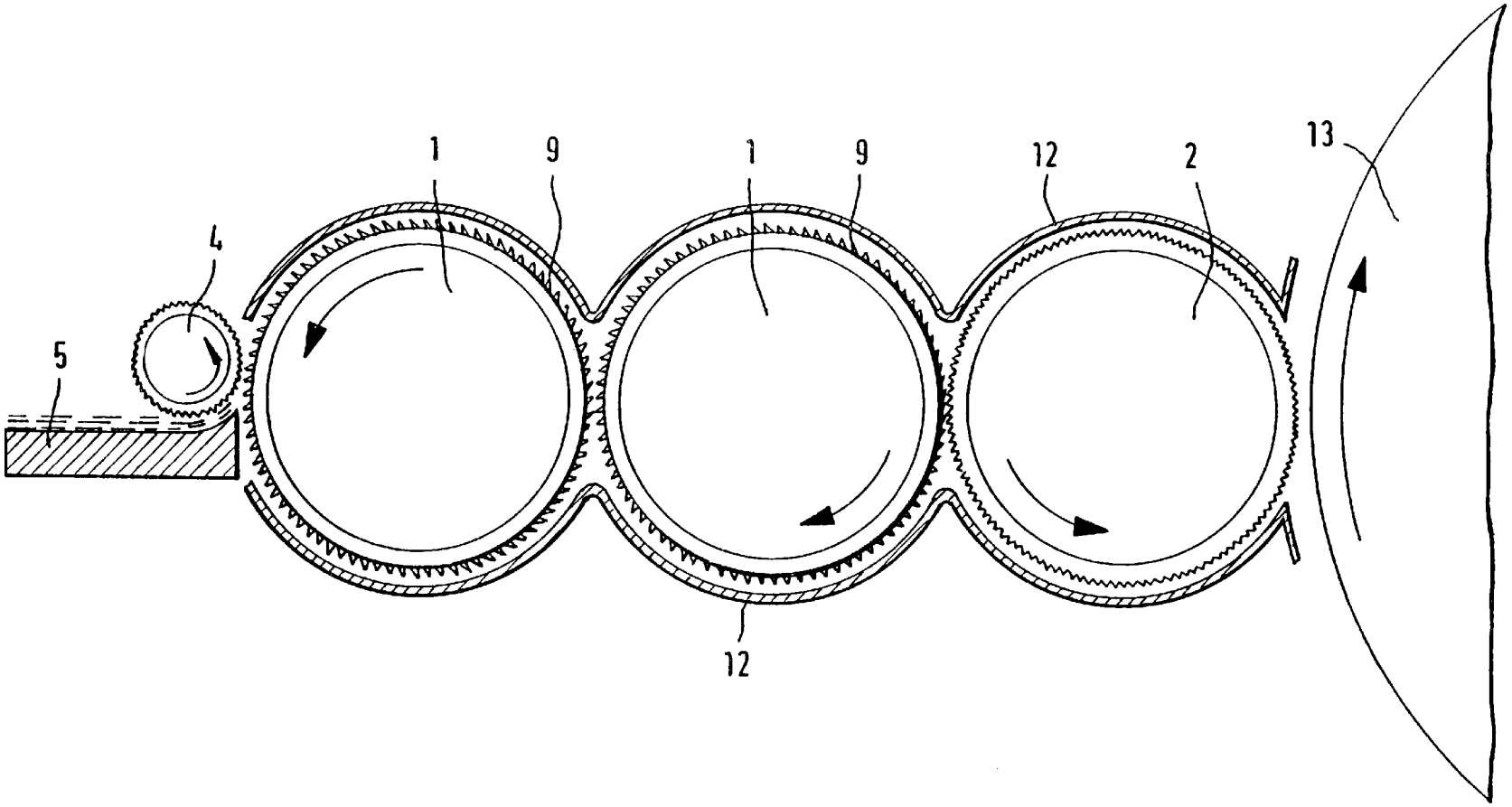
FIG. 4 is a schematic sectional side elevational view of another preferred embodiment of the invention.
Figure 5:
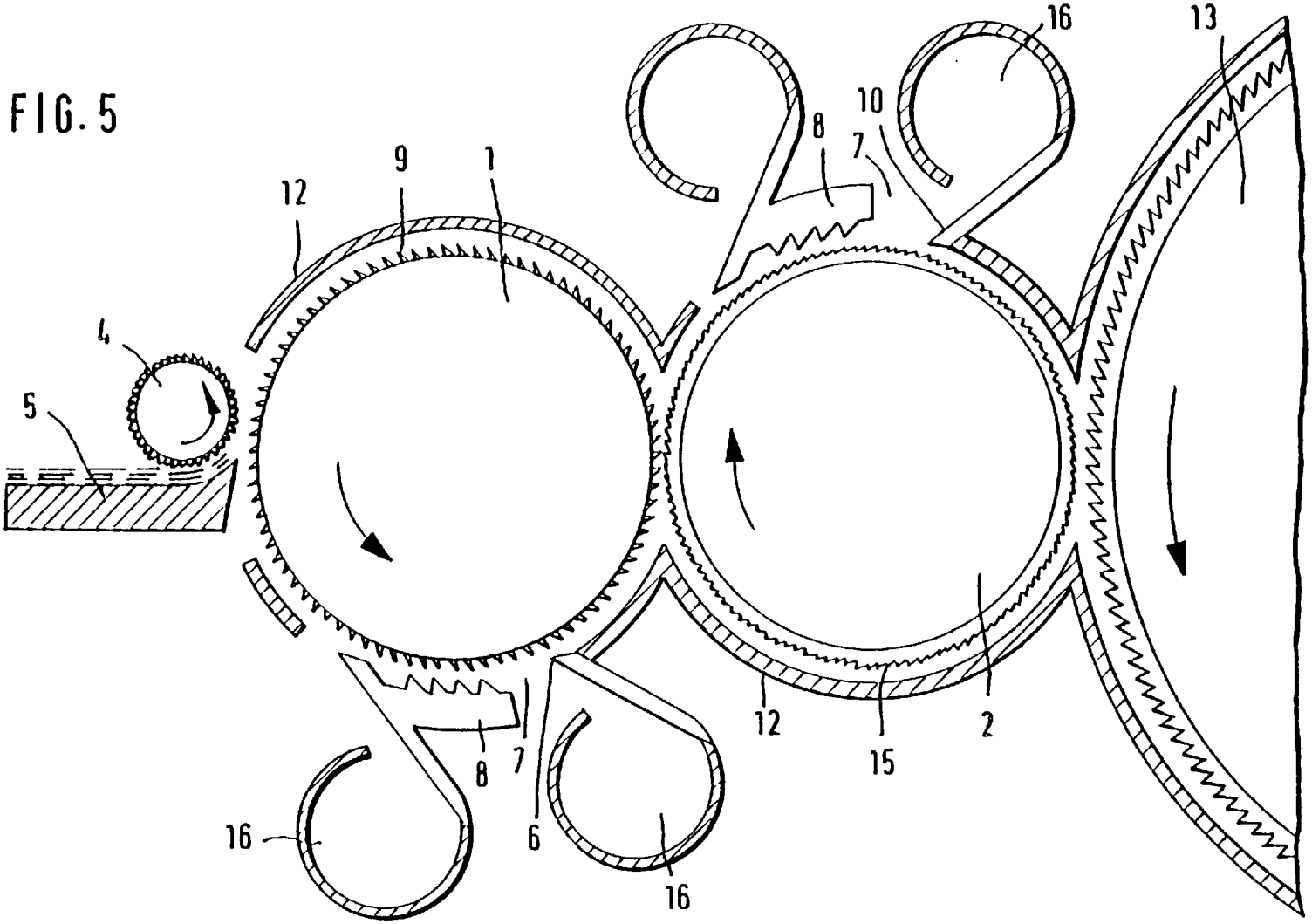
FIG. 5 is a schematic sectional side elevational view of yet a further preferred embodiment of the invention.

From the clockwise rotating licker-in 2 the fiber material is transferred to the counterclockwise rotating licker-in 3. The licker-in 3 too, is provided with a sawtooth clothing 15 which, however, is finer than the sawtooth clothing provided on the licker-in 2. The licker-in 3—or, in the FIG. 4 and 5 embodiments, the licker-in 2—transfers the fibers to the main carding cylinder 13. All the rolls 1, 2 and 3 are, to the extent possible, provided with a cover or shroud 12.

FIGS. 3*a* and 3*b* illustrate a segment of the pin roll 1. On the cylinder surface 14 of the pin roll 1 a plurality of preferably steel pins 9 are secured. The pins which are sharpened to a point only at their free exterior are inclined in the direction of rotation A at an angle $\alpha$ of between, for example, 5°–25° relative to the roll radius extending to the respective pin. The radially measured height c of the pins 15 from the cylinder surface 14 is, for example, 4–20 mm. According to the illustration in FIG. 3*b*, the pin density on the surface 14 is approximately 0.5–2 pins per $cm^2$. The direction of axis of the roll 1 is designated at G. The diameter of the pins 9 is e and may be, for example, 2–4 mm. The distance d between the cutting edge 6 and an imaginary circumscribed cylinder is between 0.5 and 5 mm.

It will be understood that the above description of the present invention is susceptible to various modifications, changes and adaptations, and the same are intended to be comprehended within the meaning and range of equivalents of the appended claims.

What is claimed is:

1. In a carding machine including a main carding cylinder and an apparatus for introducing fiber material to the main carding cylinder; the apparatus including a fiber feeding device and at least one licker-in having a sawtooth clothing and being disposed between the fiber feeding device and the main carding cylinder; the improvement wherein said apparatus comprises at least one pin roll having a pin clothing; said pin roll including a securing surface; said pin clothing including a plurality of pins embedded into and projecting from said securing surface; said pins of said pin clothing being arranged on a surface of said pin roll at a density of about 0.5 to 2 pins/$cm^2$; said pin roll immediately adjoining said fiber feeding device and being situated between said fiber feeding device and said licker-in.

2. The carding machine as defined in claim 1, wherein said fiber feeding device comprises a feed roll and a feed table cooperating with said feed roll.

3. The carding machine as defined in claim 1, wherein said pin roll has a horizontally-oriented axis of rotation; further comprising a curved cover situated underneath said pin roll and closely following a periphery thereof.

4. The carding machine as defined in claim 1, wherein each said pin roll and said licker-in have a diameter of approximately 160 to 200 mm.

5. The carding machine as defined in claim 1, further comprising a stationary carding element cooperating with each said pin roll and licker-in.

6. The carding machine as defined in claim 1, wherein each said pin roll and licker-in has the same diameter.

7. The carding machine as defined in claim 1, wherein said pin roll has a horizontally-oriented axis of rotation; further comprising a curved cover situated above said pin roll and closely following a periphery thereof.

8. The carding machine as defined in claim 1, wherein the pins of said pin clothing project from a surface of said pin roll to a radial height of about 4 to 20 mm.

9. The carding machine as defined in claim 1, further comprising means defining a waste discharge opening stationarily positioned along a periphery of each said pin roll and licker-in and a mote knife bordering said waste discharge opening.

10. The carding machine as defined in claim 9, wherein a distance between a knife edge of each mote knife and an imaginary cylinder circumscribable about the pins of said pin roll is about 0.5 to 5 mm.

11. The carding machine as defined in claim 9, further comprising a stationary carding element adjoining each mote knife downstream thereof as viewed in a direction of licker-in rotation.

12. The carding machine as defined in claim 9, further comprising a suction hood adjoining each said mote knife for drawing away waste through said waste discharge opening.

13. The carding machine as defined in claim 9, further comprising a guide element bordering said waste discharge opening; said mote knife and said guide element together forming said means defining said waste discharge opening.

14. The carding machine as defined in claim 1, wherein said pin roll has a clothing formed of pins; said pins being inclined at an angle relative to a radial orientation in a direction of rotation of said pin roll.

15. The carding machine as defined in claim 14, wherein said angle is approximately 10° to 150°.

16. The carding machine as defined in claim 1, wherein said licker-in is a first licker-in; further comprising a second licker-in immediately adjoining the first licker-in downstream thereof as viewed in a direction of fiber advance from the fiber feeding device; said second licker-in having a sawtooth clothing.

17. The carding machine as defined in claim 16, wherein a rotary direction of any selected licker-in is opposite to a rotary direction of a licker-in adjoining the selected licker-in.

18. The carding machine as defined in claim 16, wherein a rotary speed of any selected licker-in is greater than a rotary speed of a licker-in adjoining the selected licker-in upstream thereof as viewed in a direction of fiber advance through said apparatus.

19. The carding machine as defined in claim 1, wherein said licker-in immediately adjoins said pin roll.

20. The carding machine as defined in claim 1, wherein said pins have a diameter of 2 to 4 mm.

* * * * *

UNITED STATES PATENT AND TRADEMARK OFFICE

CERTIFICATE OF CORRECTION

PATENT NO. : 5,862,573
DATED : January 26, 1999
INVENTOR(S) : Ferdinand Leifeld

It is certified that error appears in the above-indentified patent and that said Letters Patent is hereby corrected as shown below:

On the title page, item [30], the following additional information should be inserted --Foreign Application Priority Data

| | | |
|---|---|---|
| September 14, 1990 | Germany | 40 29 414. |
| September 15, 1993 | Germany | 43 31 284.5.-- |

Signed and Sealed this

Nineteenth Day of September, 2000

*Attest:*

Q. TODD DICKINSON

*Attesting Officer*

*Director of Patents and Trademarks*